US011679618B2

(12) United States Patent
Ichikawa

(10) Patent No.: US 11,679,618 B2
(45) Date of Patent: Jun. 20, 2023

(54) INK RESERVOIR UNIT FOR WRITING INSTRUMENTS AND WRITING INSTRUMENTS

(71) Applicant: MITSUBISHI PENCIL COMPANY, LIMITED, Tokyo (JP)

(72) Inventor: Shuji Ichikawa, Tokyo (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 17/436,832

(22) PCT Filed: Feb. 27, 2020

(86) PCT No.: PCT/JP2020/008011
§ 371 (c)(1),
(2) Date: Sep. 7, 2021

(87) PCT Pub. No.: WO2020/208971
PCT Pub. Date: Oct. 15, 2020

(65) Prior Publication Data

US 2022/0176728 A1 Jun. 9, 2022

(30) Foreign Application Priority Data

Apr. 9, 2019 (JP) ..... JP2019-074061

(51) Int. Cl.
*B43K 7/02* (2006.01)
*B43K 7/00* (2006.01)
(Continued)

(52) U.S. Cl.
CPC ..... *B43K 7/02* (2013.01); *B43K 7/005* (2013.01); *B43K 5/005* (2013.01); *B43K 8/003* (2013.01)

(58) Field of Classification Search
CPC ..... B43K 7/02; B43K 5/005; B43K 7/005; B43K 3/00; B43K 5/02; B43K 8/003; B43K 15/00
(Continued)

(56) References Cited

U.S. PATENT DOCUMENTS 3,583,820 A * 6/1971 Koeln ..... B43K 7/12 401/107
4,305,179 A * 12/1981 Sakurada ..... F16L 33/03 24/23 R
(Continued)

FOREIGN PATENT DOCUMENTS

DE 91 10 311 U1 12/1991
DE 40 25 199 A1 2/1992
(Continued)

OTHER PUBLICATIONS

International Search Report dated Apr. 7, 2020, issued in counterpart International Application No. PCT/JP2020/008011, with English Translation. (4 pages).
(Continued)

*Primary Examiner* — David J Walczak
(74) *Attorney, Agent, or Firm* — WHDA, LLP

(57) ABSTRACT

An ink reservoir unit for a writing instruments using an ink reservoir tube with which low contamination can be achieved considering environmental problems; and a writing instruments using the same. The ink reservoir tube is composed of a composite material in which a raw material is layered on a paper substrate having paper as a substrate. One end section of the ink reservoir tube is coupled to a connection part formed on a writing member or a relay member that holds the writing member to constitute the ink reservoir unit for a writing instrument. In one preferred aspect, a locking device using a male thread formed on an outer peripheral surface is provided to the connection part to be
(Continued)

connected to the ink reservoir tube, and the ink reservoir tube is coupled to the relay member that holds the writing member by the locking device.

8 Claims, 13 Drawing Sheets

(51) Int. Cl.
*B43K 5/00* (2006.01)
*B43K 8/00* (2006.01)

(58) Field of Classification Search
USPC ..... 401/198, 199, 207, 216, 249, 251
See application file for complete search history.

(56) References Cited

U.S. PATENT DOCUMENTS

| | | | | |
|---|---|---|---|---|
| 5,399,041 | A * | 3/1995 | Chiswell | B43K 19/145 401/241 |
| 5,401,257 | A * | 3/1995 | Chevalier, Jr. | A61M 25/0017 604/93.01 |
| 7,811,019 | B2 * | 10/2010 | Yoder | B43K 5/005 401/6 |
| 10,137,268 | B2 * | 11/2018 | Reinberg | A61M 16/0497 |
| 2005/0123341 | A1 | 6/2005 | Ichikawa et al. | |
| 2006/0075924 | A1 | 4/2006 | Kobayashi et al. | |

FOREIGN PATENT DOCUMENTS

| | | | |
|---|---|---|---|
| JP | S62-9997 | A | 1/1987 |
| JP | 62-70097 | A | 3/1987 |
| JP | 2001-146090 | A | 5/2001 |
| JP | 2003-200690 | A | 7/2003 |
| JP | 2004-314317 | A | 11/2004 |
| JP | 2008-1009 | A | 1/2008 |
| JP | 2017-87457 | A | 5/2017 |
| KR | 10-2004-0060889 | A | 7/2004 |
| WO | 2020/044737 | A1 | 3/2020 |

OTHER PUBLICATIONS

Extended (Supplementary) European Search Report dated Nov. 24, 2022, issued in counterpart EP application No. 20786899.3. (8 pages).

* cited by examiner

INK RESERVOIR UNIT FOR WRITING INSTRUMENTS AND WRITING INSTRUMENTS

BACKGROUND OF THE INVENTION

Field of the Invention

The present invention relates to ink reservoir unit of writing instruments to be used for such as ballpoint pens and marking pens and to writing instruments.

Description of the Related Art

As for an ink reservoir tube for a ballpoint pen, one tip end, such as a front tip end, of the ink reservoir tube is typically press-fitted to a ballpoint pen tip as a writing member or to a relay member holding a ballpoint pen tip.

A transparent or semi-transparent resin material, such as polypropylene, is used for the ink reservoir tube in order to secure the easiness of molding and visibility of the amount of ink.

In recent years, issues on microplastics flowing into the ocean become drawn attention, and efforts to solve global environmental problems such as reduction of the use of disposable plastics are growing. Several proposals focus on plastic-free materials for each part that make up a writing instrument; Patent Literature 1 discloses an ink reservoir tube material for writing instruments employing an ink reservoir tube having a multi-layer structure formed by molding one or two or more resin layers inside a reservoir base member made of biodegradable resin. The document recites that since the reservoir base member made of biodegradable resin biodegrades as the time lapses, this contributes to the lessening of the amount of synthetic resin to be disposed wastes.

Patent Literature 2 proposes a writing instrument provided with a barrel, which is made by spiral-forming of a composite material prepared by layering a synthetic resin having barrier characteristics or a metal such as aluminum on a paper base. The barrel for the writing instrument is made of materials having a layered structure that is composed of, from the outside, an aluminum-coated label paper whose backside is made of kraft paper, two liner-paper layers stacked, a polyethylene layer formed on the inner surface thereof, and a polyester layer with vapor-deposited aluminum outside. With this barrel, a writing instrument that allows achieving a lowering of pollution with maintaining durability by using composite materials containing a paper base can be provided.

LIST OF REFERENCE

Patent Literature

Patent Literature 1: JP-A-2001-146090
Patent Literature 2: JP-A-62-70097

SUMMARY OF THE INVENTION

As described above, products using biodegradable resins and paper-based materials are appropriate for lowering pollution; products that take environmental problems into consideration can be provided if base materials containing pulp or paper that are alternatives to plastics are used.

The present invention is made from the above viewpoint and aims at achieving deplasticization by replacing ink reservoir tubes formed of polypropylene described in the beginning with those made of paper-based materials.

Composite materials containing paper-based materials are weak in mechanical strength compared to polypropylene or the like that are conventionally used. Accordingly, when the composite materials are employed in an ink reservoir tube, it is an important issue to devise a method to secure a certain connection strength at a connection part of an ink reservoir tube with a writing member or a relay member that holds a writing member.

One of the principal issues to be solved by the present invention is to provide an ink reservoir unit for writing instruments using an ink reservoir tube which takes an environmental problem into consideration that can achieve low pollution. Another principal issue is to provide an ink reservoir unit of high practicality for writing instruments and a writing instrument using the ink reservoir tube, by constructing to secure a certain connection strength at a connection part of an ink reservoir tube with a writing member or a relay member holding a writing member.

The technical features of the ink reservoir unit for writing instruments according to the present invention are that the ink reservoir tube is formed of a paper-based material and that one end of the ink reservoir tube is attached to a connection part formed on a writing member or a relay member holding a writing member.

In this case, a locking means is desirably equipped to secure a certain connection strength for the ink reservoir tube at a connection part of a writing member or a relay member holding a writing member. As an example, a first locking means using a male thread formed on an outer peripheral surface of the ink reservoir tube at the connection part is provided. As another example, a second locking means is provided in which a tapered face whose diameter is expanding toward the tip end of a writing member and a plurality of annular locking portions that sharply reduces the diameter continuously from the tapered face is formed along an axis direction.

As still another example, a third locking means is provided in which a plurality of protrusions each having a tapered face gradually rising toward the tip end of a writing tip and a falling portion whose diameter reduces at an acute angle following the tapered face is discontinuously formed along a circumferential and axial direction.

In addition, another configuration is also suitably employed where a ring-shaped reinforcing member is fitted to an outer peripheral surface of the ink reservoir tube at the connection part where the ink reservoir tube and a writing member or a relay member holding a writing member are connected.

Further, another configuration is also suitably employed where a reinforcing member with a C-shaped cross-section perpendicular to the axis is fitted on the outer peripheral surface of the ink reservoir tube at the connection part where the ink reservoir tube is connected with a writing member or a relay member holding a writing member.

As one of locking means capable of securing a certain strength for an ink reservoir tube, a fourth locking means is usable that is composed of a tapered portion formed on a writing member or a relay member to which the front end of the ink reservoir tube is inserted and a fastening ring having a press-contact surface which is pressingly contacted to an outer surface of the ink reservoir tube at the tapered portion. In the above case, a female thread is desirably formed on the fastening ring that is to be screwed with the male thread formed on the writing member or the relay member.

As another one of locking means, a fifth locking means can be used which includes a cylindrical body formed on the writing member or the relay member and to which the front end of the ink reservoir tube is inserted, a garter spring (an annular spring) that is housed in the bottom portion of the cylindrical body and pressingly in contact with the front end of the ink reservoir tube, and a pressing ring housed in the cylindrical body to position the garter spring at the bottom portion of the cylinder.

The writing instrument according to the present invention is constituted by housing into the barrel the ink reservoir unit for writing instruments including each of the locking means. Or, the writing instrument according to the present invention is constituted by housing into the barrel the ink reservoir unit for writing instruments formed by including each of the locking means and further combining with the reinforcing members. Further, the writing instrument according to the present invention is constituted that an ink reservoir tube in an ink reservoir unit forms a barrel serving as a grip. Or the writing instrument according to the present invention is constituted that an ink reservoir tube in an ink reservoir unit provided with each of the locking means and the reinforcing members forms a barrel serving as a grip.

According to the present invention, with the use of paper-based material for the material of the ink reservoir tube, an ink reservoir unit for writing instruments can be provided that takes an environmental problem that can achieve the reduction of the amount of plastics usage into consideration.

Further, an ink reservoir unit of high practicality for writing instruments can be provided having a certain connection strength and a writing instrument using the ink reservoir unit by providing each of the above described locking means for the ink reservoir tube to a writing member or a relay member holding a writing member.

BRIEF DESCRIPTION OF THE DRAWINGS

FIG. 1A is an elevation and FIG. 1B is a central cross-sectional view;

FIG. 2A is a perspective view of the principal member, FIG. 2B is a front view of the principal member, and FIG. 2C is an enlarged cross-sectional view of the principal member;

FIG. 3A is a perspective view of the principal member, FIG. 3B is a front view of the principal member, and FIG. 3C is an enlarged cross-sectional view of the principal member;

FIG. 4A is a perspective view of the principal member, and FIG. 4B is a front view of the principal member;

FIG. 5A is perspective view of a reinforcing member before attached, FIG. 5B is an enlarged perspective view of a principal member, and FIG. 5C is an enlarged perspective view of the principal member with the reinforcing member attached;

FIG. 7A is perspective view of a reinforcing member before attached, FIG. 7B is an enlarged perspective view of a principal member, and FIG. 7C is an enlarged perspective view of the principal member with the reinforcing member attached;

FIG. 8A is a central cross-sectional view and FIG. 8B is an enlarged cross-sectional view of a principal member;

FIG. 9A is a front view, FIG. 9B is a cross-sectional view;

FIG. 11A is a front view of the writing instrument with a clip positioned upper side and FIG. 11*b* is a central cross-sectional view thereof;

FIG. 12A is a perspective view of the writing instrument with a cap detached and FIG. 12B is a central cross-sectional view thereof; FIG. 13A is a perspective view of the writing instrument and FIG. 13B is a front view thereof and FIG. 13C is a central cross-sectional view thereof.

DESCRIPTION OF THE PREFERRED EMBODIMENTS

Figure 1A:
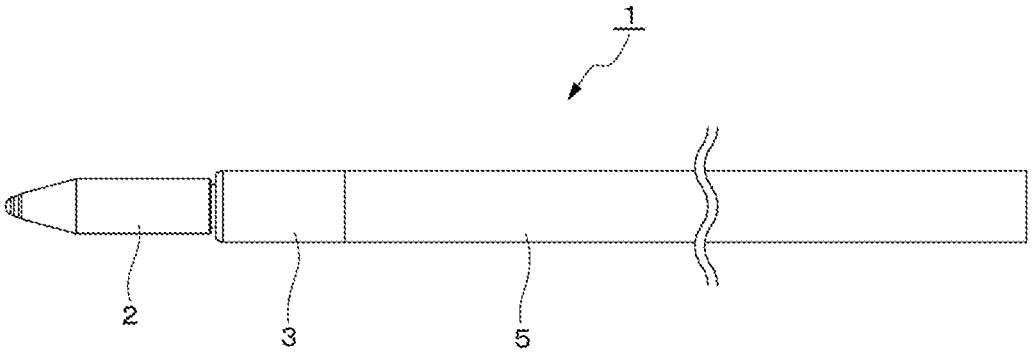
FIG. 1A and FIG. 1B show a first embodiment of an ink reservoir unit according to the present invention, where

An ink reservoir unit and a writing instrument using the ink reservoir unit will be described on the basis of embodiments shown in the drawings. In the drawings below, parts and members functioning the same are indicated with the same referential numerals and the description to be duplicated will be properly omitted.

FIG. 1 shows a first embodiment of an ink reservoir unit for writing instruments, and a ballpoint pen tip 2 provided with a writing ball at a tip end is used as a writing member constituting the ink reservoir unit 1 for writing instruments.

In the first embodiment, a ballpoint pen tip 2 made of stainless steel is press-fittedly attached to a relay member 3 made of a metal material. A connection part 3*a* of an ink reservoir tube having a reduced diameter is formed at the rear half portion of the relay member 3, and a front end of the ink reservoir tube 5 is connected by fitting with covering the connection part 3*a*.

In the first embodiment, the connection part 3*a* of the ink reservoir tube is formed to be a straight cylinder. A certain connecting strength can be imparted to the connected-byfitting ink reservoir tube 5 by applying an adhesive, for example, to the connection part 3 in advance.

Figure 1B:
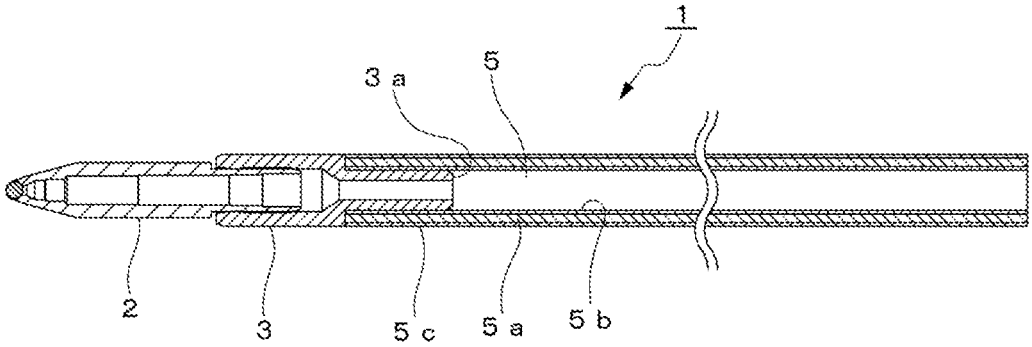

The ink reservoir tube 5 described in this embodiment has a three-layer structure as shown in FIGS. 1B and 1*s* composed of an inner layer 5*b*, which is in contact with ink (not shown), a base layer 5*a* in the middle, and an outer layer 5*c* covering the base layer 5*a*.

The base layer 5*a* in the middle is formed of a paper-based material, the inner layer 5*b* is made of a resin material or aluminum, and further, the outer layer 5*c* is made of a resin material.

The paper-based material of which the base layer 5*a* is made is mono-layered or multilayered material, and is desirably excellent in bending resistance for molding, drop impact absorption, and water resistance at the end face.

The paper-based material is a sheet-shaped material mainly made of pulp, and may additionally include fillings, and different auxiliary materials. The pulp is chemical pulp, mechanical pulp, non-wood fiber, and others, and a proper mixture of those materials is also usable.

The resin material that constitutes the inner layer 5*b* is desirably easy forming and not soluble to a water-base or oil-based ink; that is, the ink does not penetrate up to the base layer 5*a*.

In addition, the resin material is desirably acrylic resin, polystyrene, fluoric resin, silicone, or a combination thereof, or biodegradable plastics such as polylactic acid resin from the viewpoint of high strength, easiness of handling, and availability. Biodegradable plastics are preferable as an environmentally friendly material for the ink reservoir tube as long as possibly imparted with the necessary strength and lifetime as the ink reservoir tube.

The inner layer 5*b*, when constituted with an aluminum layer as described above, is soluble neither to water-based nor oil-based ink and surely prevents the penetration of ink up to the base layer 5*a* made of paper-based material.

The resin material that constitutes the outer layer 5*c*, similar to the resin material that constitutes the inner layer 5*b*, is desirably easy forming and not soluble to a water-base or oil-based ink and does not penetrate to the base layer 5*a*.

Further, the resin material that does not absorb moisture in the outer air is desirable.

As the resin materials constituting the outer layer 5*c*, similar resin materials are cited to those that constitute the inner layer 5*b*. Both resin materials may be the same or different.

Figure 2A:
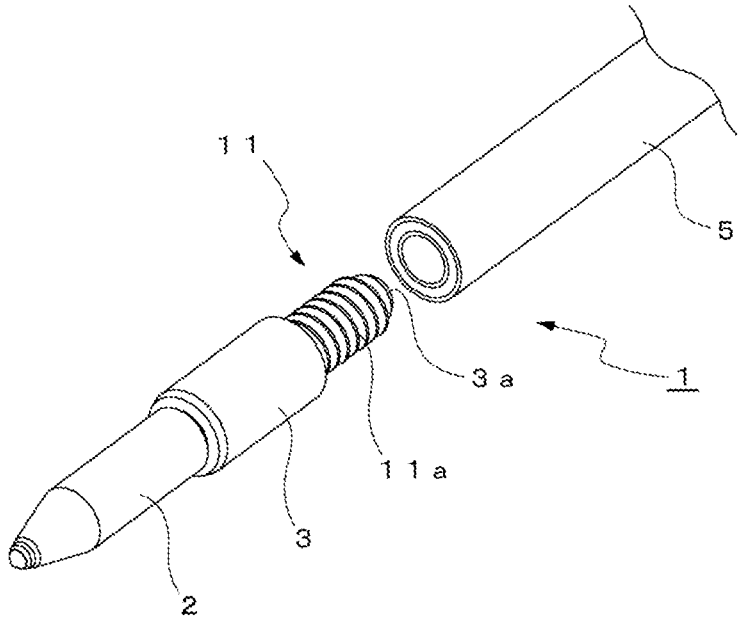
FIG. 2A through FIG. 2C show appearance constitution of a second embodiment of the ink reservoir unit for writing instruments where a writing member and an ink reservoir tube are separated.
Figure 2B:
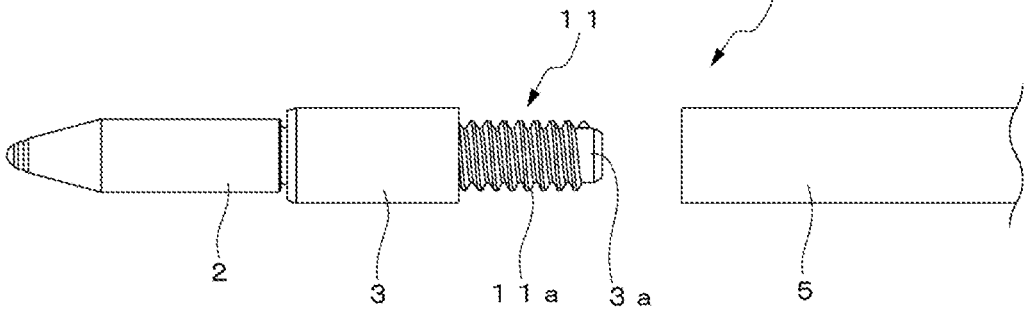
Figure 2C:
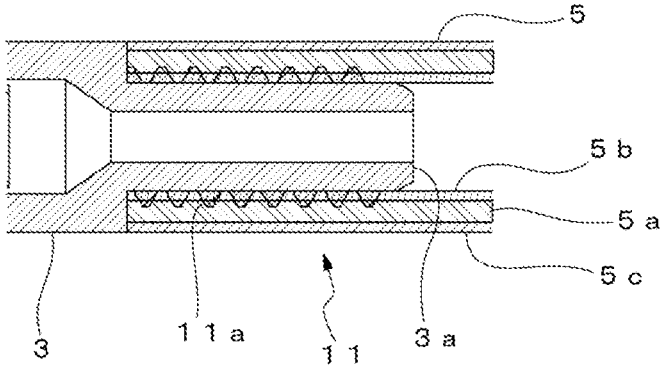

FIGS. 2A through 2C show a second embodiment of an ink reservoir unit. In the ink reservoir unit 1 in the embodiment, on a connection part 3*a* of an ink reservoir tube formed on a relay member, a male thread 11*a* is made along the outer circumference of the connection part 3*a*, and the male thread 11*a* constitutes a first locking means.

According to the second embodiment, a front end of the ink reservoir tube 5 is connected by screwing to the male thread formed on the connection part 3*a* of the relay member 3. FIG. 2C shows a state where the ink reservoir tube 5 is connected with the connection part 3*a* of the relay member 3 by screwing the front end of the ink reservoir tube 5 to the male thread 11*a*.

According to the second embodiment, the higher connection strength of the ink reservoir tube 5 with the connection part 3*a* can be more secured compared to the ink reservoir unit for writing instruments described in the first embodiment shown in FIGS. 1A and 1B.

As shown in the cross-sectional view in FIG. 2C, a three-layer structure is also employed similar to the first embodiment for the ink reservoir tube 5 described in the second embodiment.

Figure 3A:
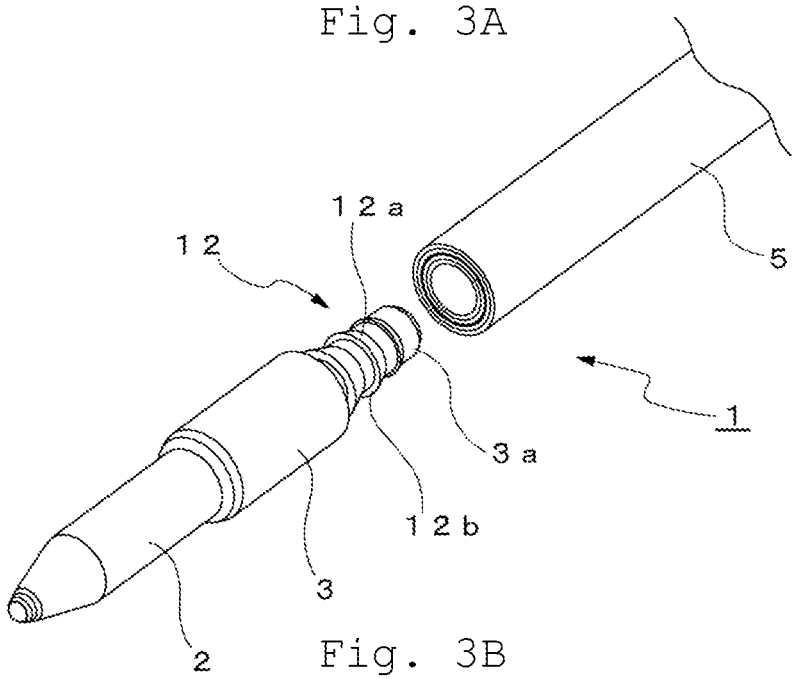
FIG. 3A through FIG. 3C show appearance constitution of a third embodiment of the ink reservoir unit for writing instruments where a writing member and an ink reservoir tube are separated.
Figure 3B:
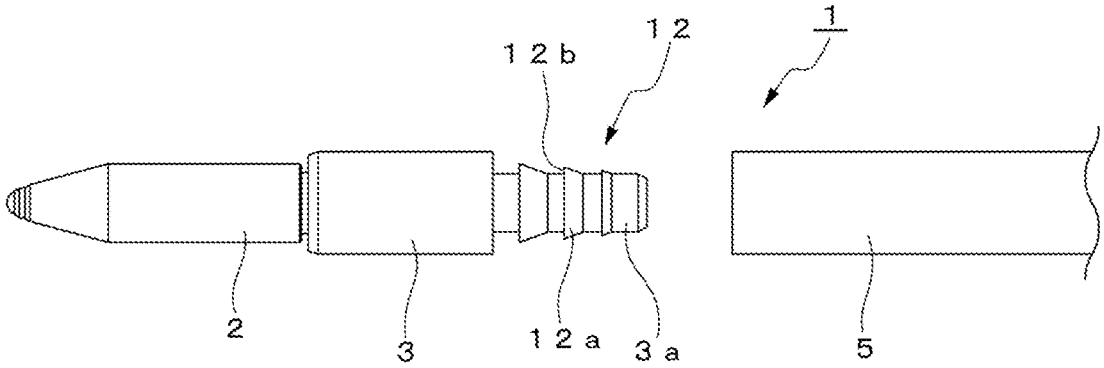
Figure 3C:
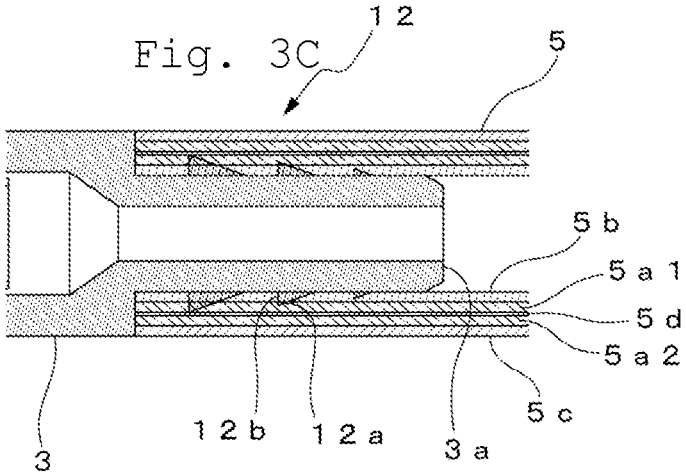

FIGS. 3A through 3C show a third embodiment of an ink reservoir unit for writing instruments. In the ink reservoir unit 1 in the embodiment, multiple, three in the figure, annular locking members 12 are formed along the axial direction on a connection part 3*a* of the ink reservoir tube formed on the relay member 3.

Each of the annular locking members 12 is provided with a tapered face 12*a* whose diameter is expanding toward the tip end of a ballpoint pen tip 2 and a falling down portion that reduces the diameter at an acute angle following the tapered face 12*a* is formed.

The annular locking member 12 that has the tapered surface 12*a* and the falling portion 12*b* is formed to have increased outer diameter sequentially along with going toward the tip end of the ballpoint pen tip 2; this structure constitutes a second locking means, indicated by the same referential number as the locking member 12.

According to the second locking means 12 shown in the third embodiment, by pushing the front end of the ink reservoir tube 5 toward the tapered face 12*a* formed on the annular locking member 12, the front end opening of the ink reservoir tube 5 is enlarged by the tapered face 12*a* and is connected to cover the connection part 3*a*.

In a state in which the front end of the ink reservoir tube 5 is connected with the connection part 3*a* as shown in FIG. 3C, the falling portion 12*b* functions similarly as the barb of a fishing hook, effectively preventing the ink reservoir tube 5 from coming off from the connection part 3*a*.

A five-layer structure is used for the ink reservoir tube 5 in the third embodiment. As shown in FIG. 3C, the ink reservoir tube includes an inner layer 5*b*, a first base layer 5*a*1, a resin layer 5*d*, a second base layer 5*a*2, and an outer layer 5*c*.

The first base layer and the second base layer are both composed of the similar paper-based material as the layer 5*a* in the middle described based on FIG. 1. The inner layer 5*b*, the resin layer 5*d*, and the outer layer 5*c* may be composed of the same material or different materials to each other. When the same material is used, a resin material similar to the material used for the inner layer 5*b* described based on FIG. 1 can be suitably used. Further, for the case where the ink reservoir tube 5 has a five-layer structure, such a structure in which only the inner layer 5*b* is made of an aluminum layer also can be adopted.

Figure 4A:
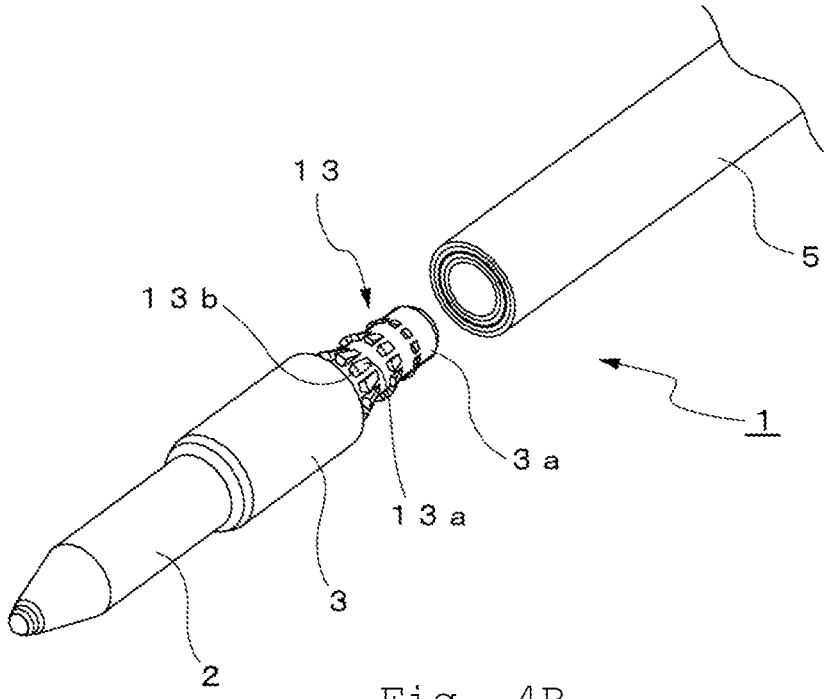
FIG. 4A through FIG. 4B show appearance constitution of a fourth embodiment of the ink reservoir unit for writing instruments where a writing member and an ink reservoir tube are separated.
Figure 4B:
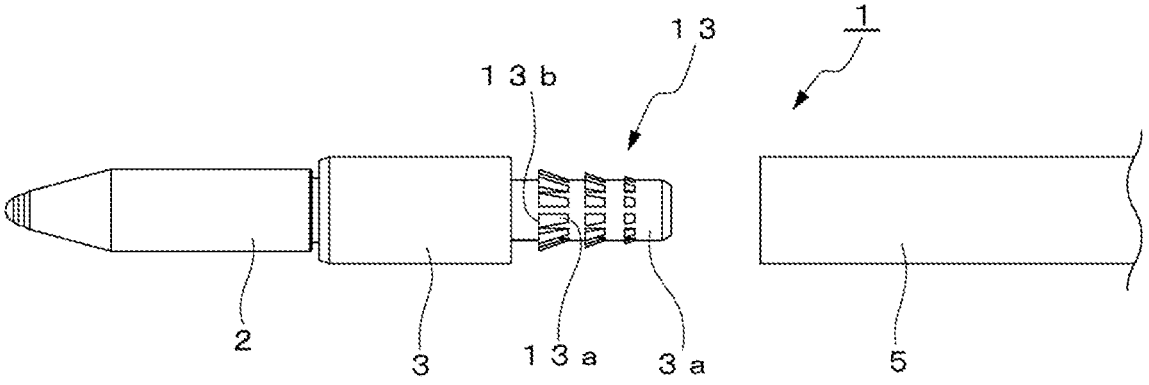

FIG. 4A-4B shows a fourth embodiment of an ink reservoir unit for writing instruments. The ink reservoir unit for writing instruments 1 described in the embodiment includes a structure of a third locking means (with the same referential number that is for the protrusion 13) where a plurality of protrusions 13 is discontinuously formed on a connection part 3*a* formed on a relay member 3 along with the circumferential and axial directions.

Further, each of the protrusions 13 has a tapered face 13*a* that gradually rises toward a ballpoint pen tip 2 and a falling portion 13*b* that falls at an acute angle continuously from the tapered face 13*a*, and the height of each of the protrusions increases toward the tip of the ballpoint pen tip 2.

Each of the protrusions 13 formed is equivalent to those that three lines of annular locking members having the tapered face 12*a* and the falling down portion 12*b* being parted by a plurality of grooves formed along the axial direction.

Accordingly, the cross-sectional view of the connection part 3*a* shown in FIG. 4 is nearly the same as the cross-sectional view shown in FIG. 3C.

Because the plurality of protrusions having tapered faces 13*a* and falling portions 13*b* are provided in the third locking means 13 shown in the fourth embodiment, an ink reservoir tube 5 is relatively easily attach by pushing the front end of the ink reservoir tube 5 into the connection part 3*a*. Further, in a state where the ink reservoir tube 5 is connected to the connection part 3*a*, the falling portion 13*b* acts to prevent the ink reservoir tube 5 from detaching from the connection part 13*a*, which is a similar action to those in the example shown in FIG. 3.

FIGS. 5A, 5B, and 5C and FIG. 6 show a fifth embodiment of an ink reservoir unit for writing instruments. In the ink reservoir unit for writing instruments 1 illustrated in this embodiment, as shown in an enlarged cross-sectional view in FIG. 6, a connection part 2*a* is formed having a reduced diameter at a rear half portion of a ballpoint pen tip 2, and an ink reservoir tube 5 is connected so as to cover the connection part 2*a*. Further, a ring-shaped reinforcing member 16 is fitted along the outer peripheral surface of the ink reservoir tube 5 that is connected to the connection part 2*a* of the ballpoint pen tip 2.

The reinforcing member 16 is mounted from the front end of the ballpoint pen tip 2 as shown in FIG. 5 such that the reinforcing member is brought pressingly into contact to the front end portion of the ink reservoir tube 5 connected to connection part 2*a* along the outer peripheral surface of the ink reservoir tube 5, whereby the connection between the ballpoint pen tip 2 and the ink reservoir tube 5 is assured.

Figure 5A:
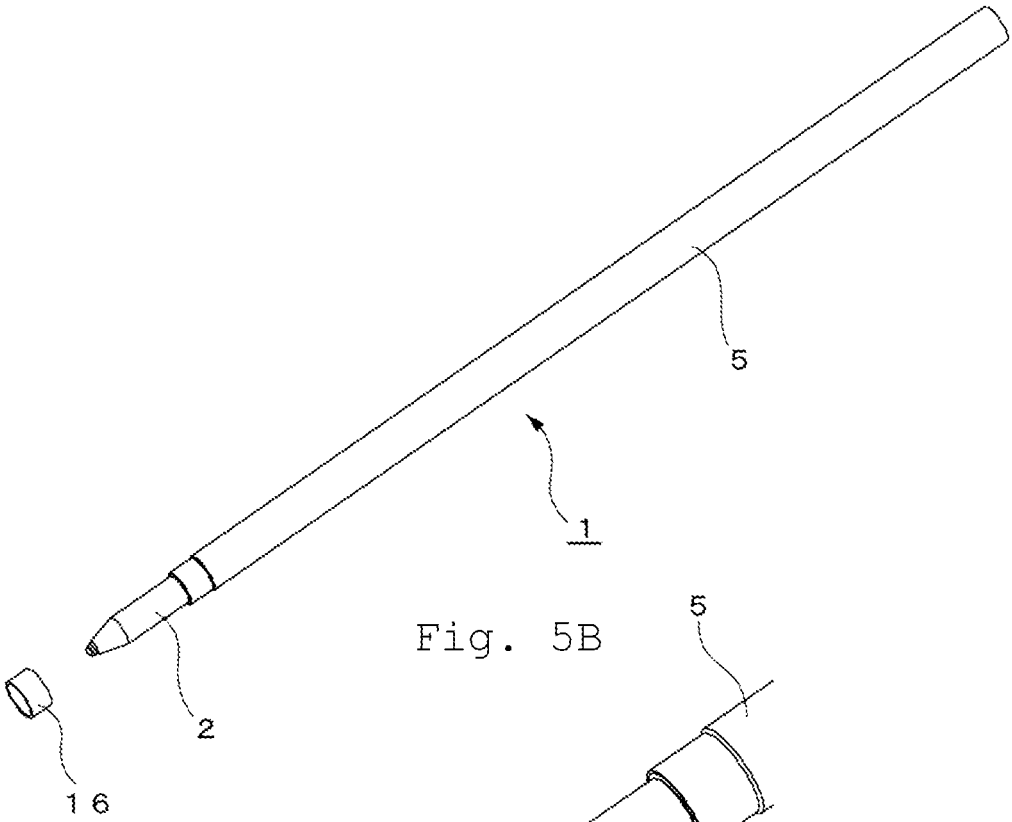
FIG. 5A through FIG. 5C show appearance constitution of a fifth embodiment of the ink reservoir unit for writing instruments.
Figure 5B:
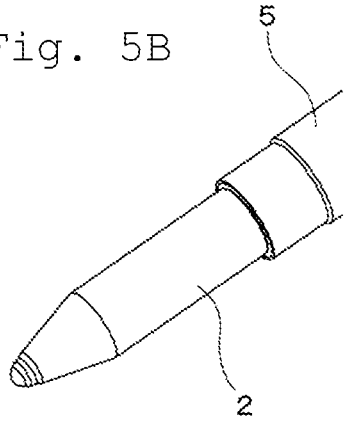
Figure 5C:
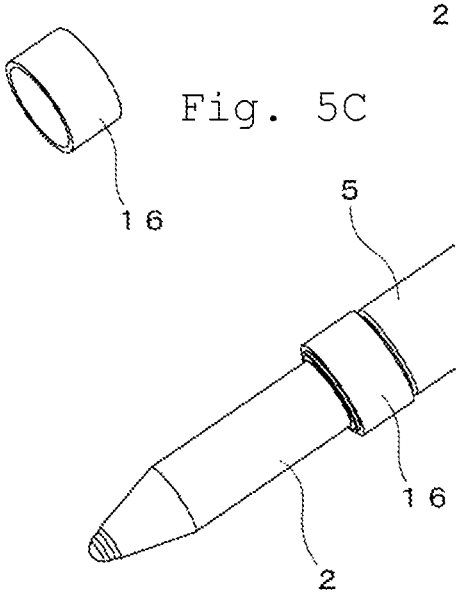

The ink reservoir tube 5 shown in FIG. 5A is illustrated with a single-layer structure, but a three-layered or a five-layered ink reservoir tube 5, previously described, may be employed as appropriate.

Figure 6:
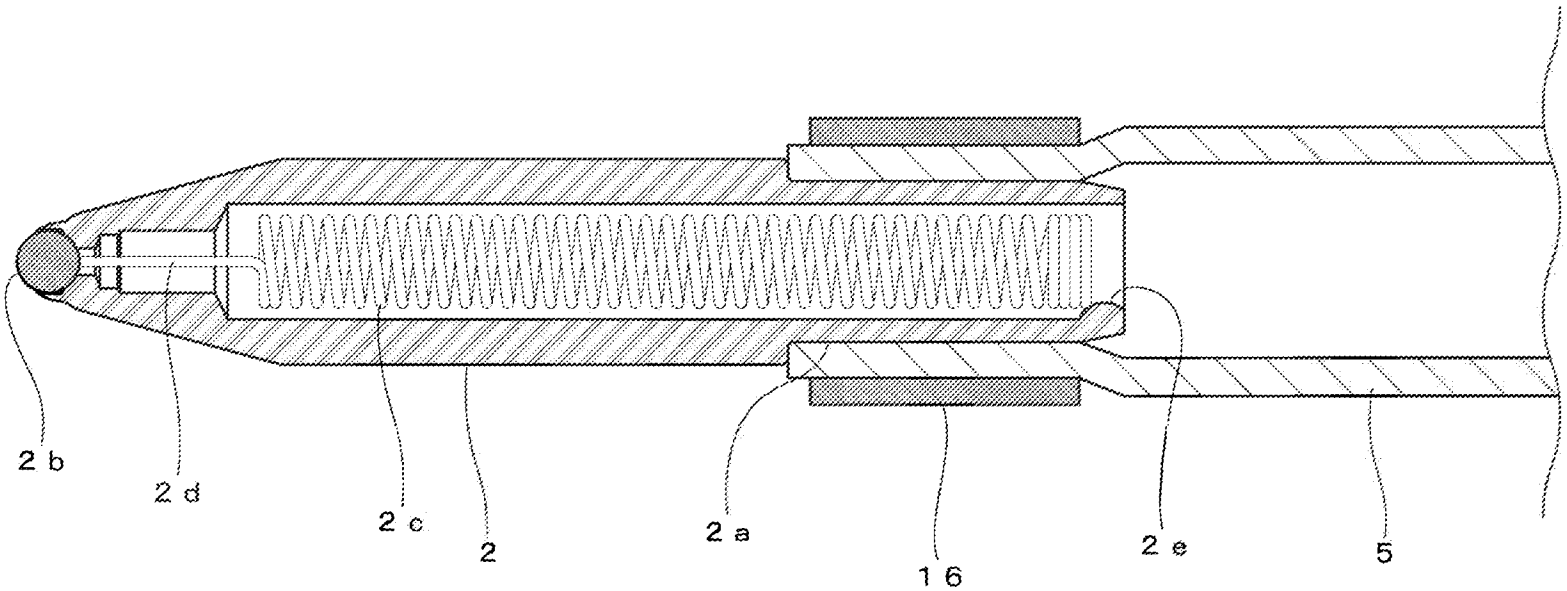
FIG. 6 is an enlarged cross-sectional view of the ink reservoir unit for writing instruments shown in FIG. 5A through 5C.

A well-known writing ball 2*b* is mounted at the tip end of the ballpoint pen tip 2 shown in FIG. 6 and in this embodiment a spring 2*c* is mounted in an inner space of the ballpoint pen tip 2. The tip end of the spring 2*c* is formed to constitute a push rod 2*d* formed in a straight rod, and the push rod 2*d* presses the writing ball 2*b* to the tip end direction.

A part of the rear end of the ballpoint pen tip 2 is caulked inward and the caulked portion locks the rear end of the spring 2*c*.

Figure 7A:
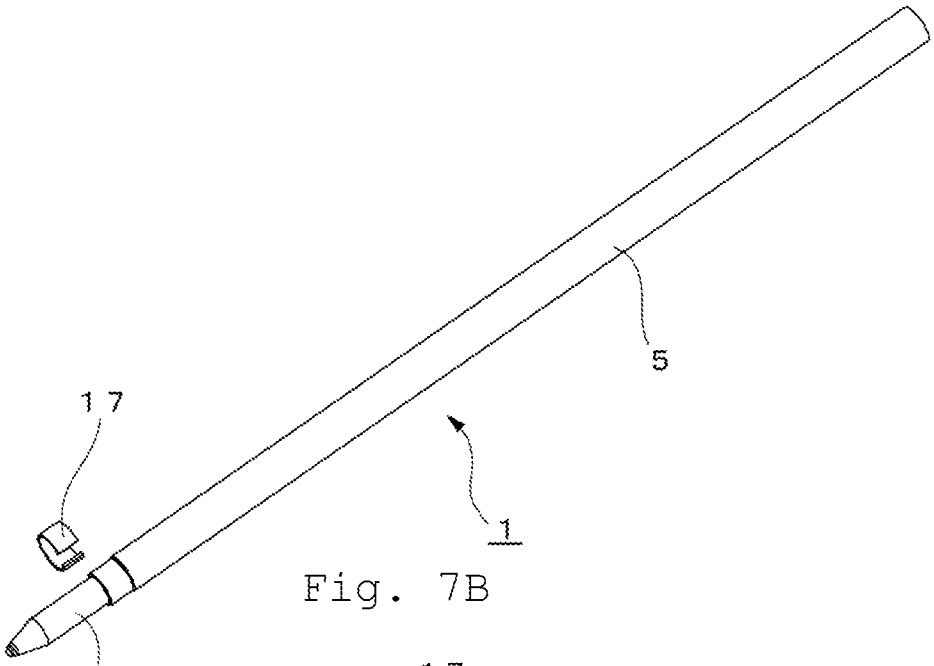
FIG. 7A through FIG. 7C show appearance constitution of a sixth embodiment of the ink reservoir unit for writing instruments.
Figure 7B:
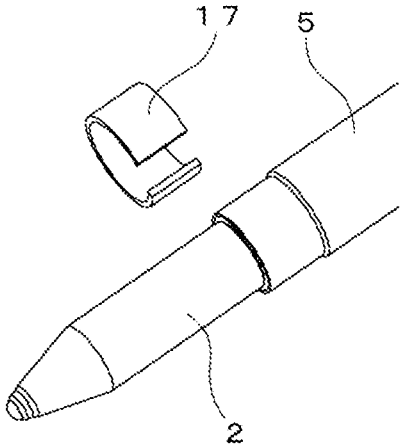
Figure 7C:
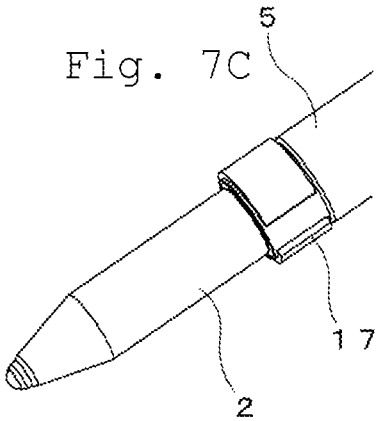

FIGS. 7A, 7B, and 7C show a sixth embodiment of an ink reservoir unit for writing instruments. In the ink reservoir unit for writing instrument 1 illustrated in this embodiment, similar to examples in FIGS. 5A, 5B, and 5C and FIG. 6, a connection part 2*a* is formed by reducing the diameter of the rear half of the ballpoint pen tip 2, and the ink reservoir tube 5 is connected to cover the connection part 2*a*.

Further, a reinforcing member 17, having a C character shape cross-section in a perpendicular direction to the axis, is fitted along the outer peripheral surface of the ink reservoir tube 5 that is connected to the connection part 2*a* of the ballpoint pen tip 2.

The reinforcing member 17 is mounted from the front end of the ballpoint pen tip 2 such that the reinforcing member is brought pressingly into contact to the front end portion of the ink reservoir tube 5 along the outer peripheral surface of the ink reservoir tube 5 connected to a connection part 2*a*.

The connection of the ink reservoir tube 5 to the ballpoint pen tip 2 is surely connected since the reinforcing member 17 is formed to have a C character shape cross-section in a perpendicular direction to the axis and has a diameter-reducing spring characteristic.

Figure 8A:
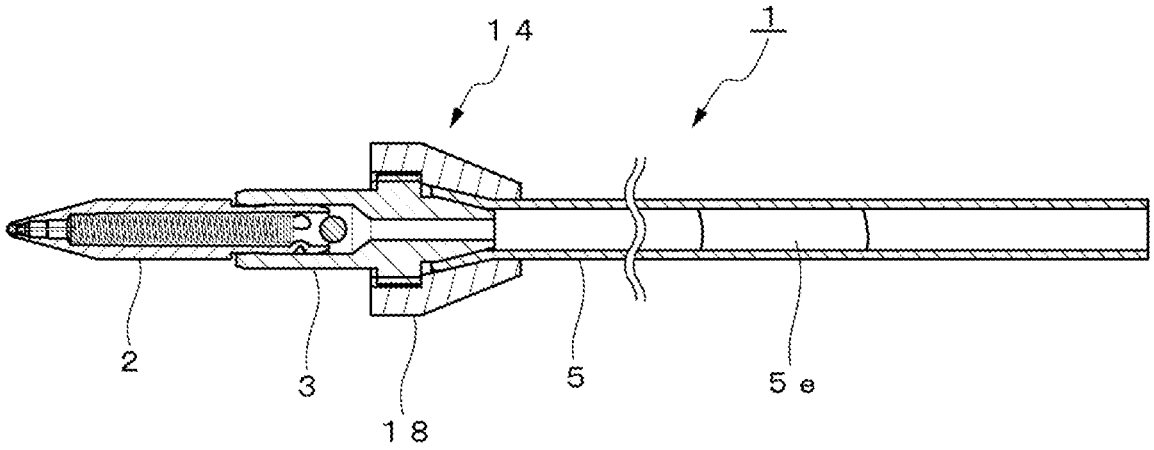
FIG. 8A and FIG. 8B show a seventh embodiment of the ink reservoir unit for writing instruments.
Figure 8B:
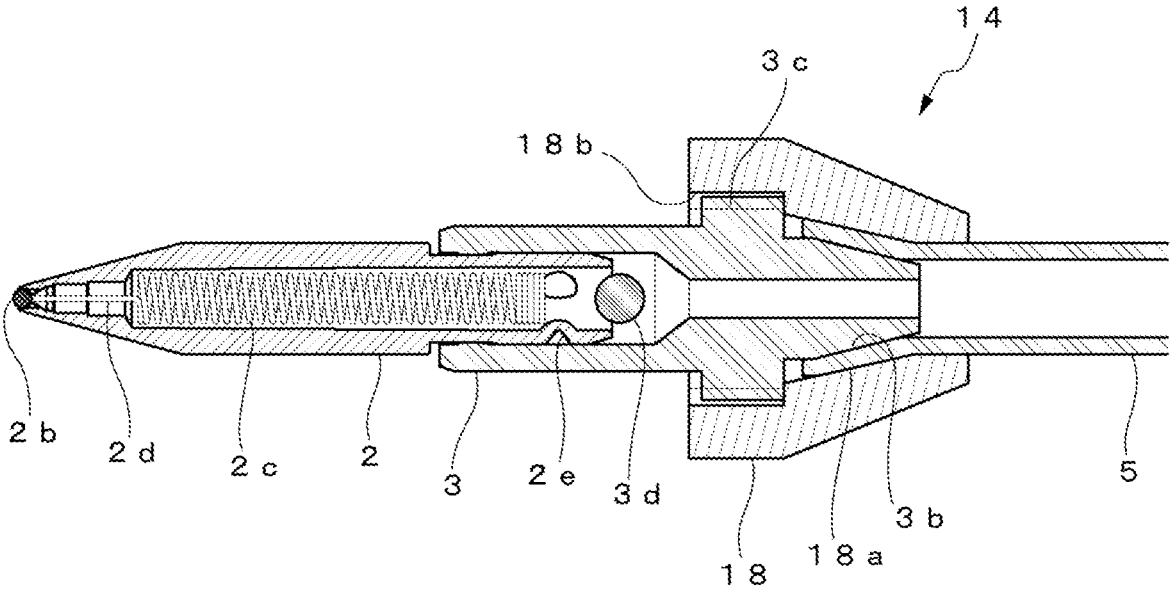
Figure 9A:
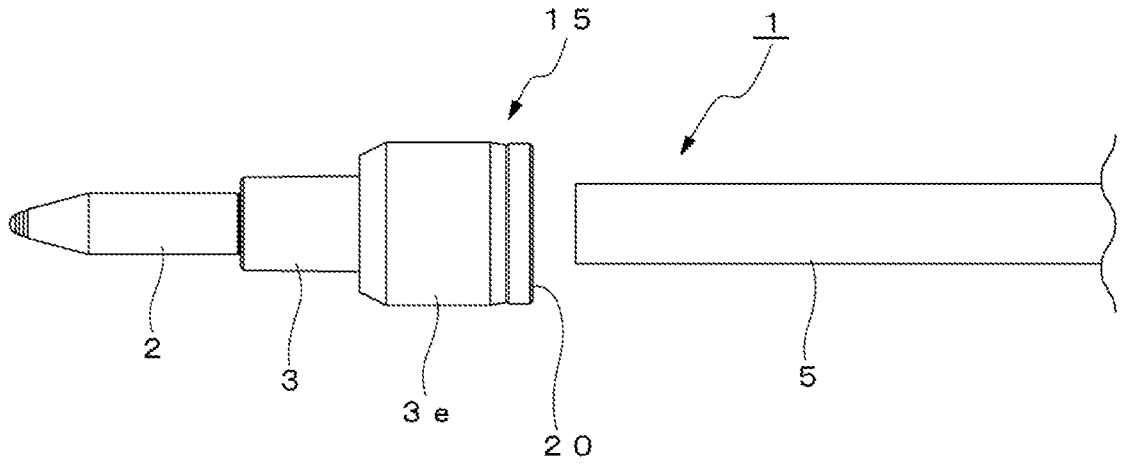
FIG. 9A and FIG. 9B show a state where a writing member and an ink reservoir tube are separated with regard to an eight embodiment of an ink reservoir unit.
Figure 9B:
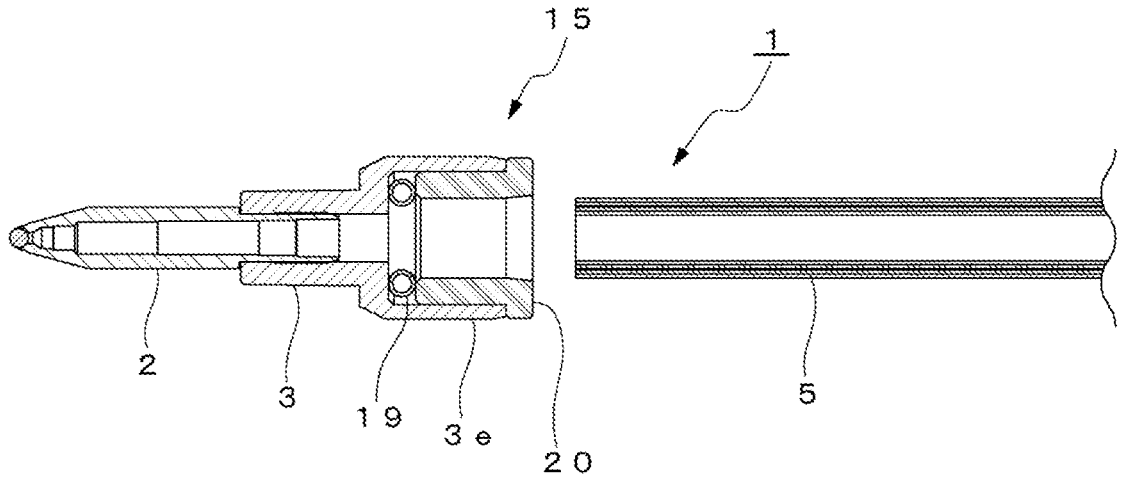
Figure 10A:
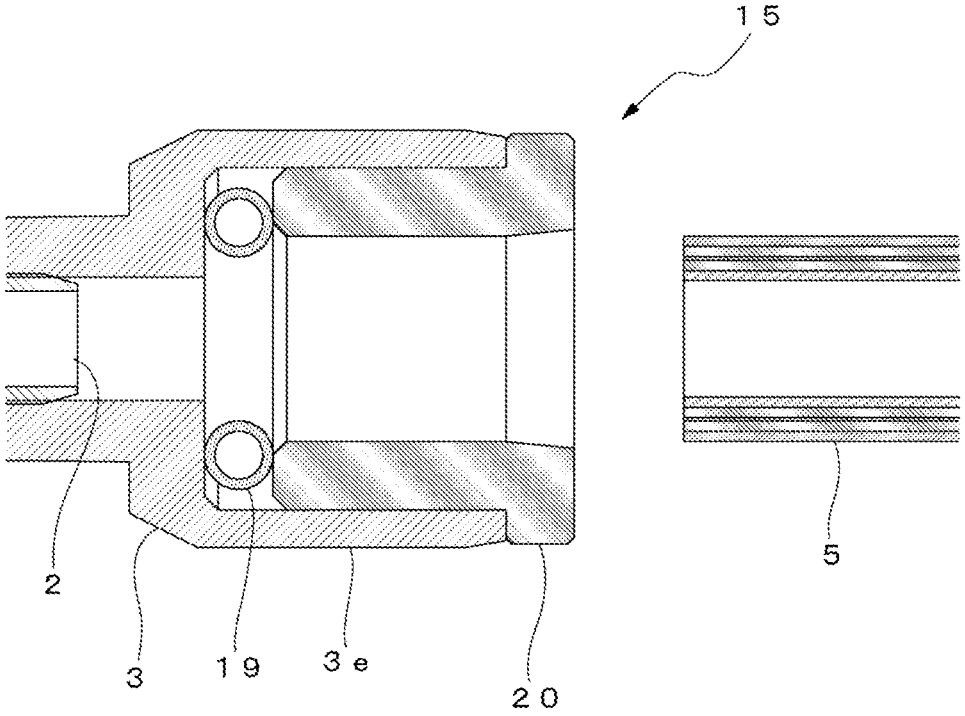
FIG. 10A is an enlarged cross-sectional view of a principal member in a state where a writing member and an ink reservoir tube are separated and FIG. 10B is an enlarged cross-sectional view of a principal member in a state where an ink reservoir tube is connected to a writing member, both with regard to the ink reservoir unit shown in FIG. 9A and FIG. 9B.
Figure 10B:
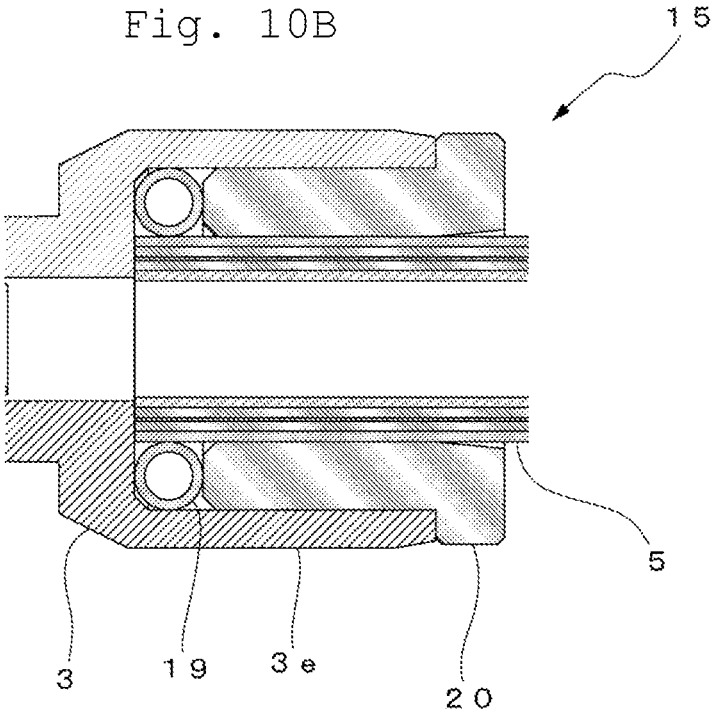

FIGS. 8A and 8B show a seventh embodiment of the ink reservoir unit.

In the ink reservoir unit 1 illustrated in this embodiment, a tapered portion 3*b*, to which the front end opening of the ink reservoir tube 5 is to be connected, is formed at the rear end of the relay member 3 that holds a ballpoint pen tip 2.

A fastening ring 18 is provided having a press-contact surface 18*a* that is pressingly in contact to the outer surface of the ink reservoir tube 5 at the tapered portion 3*b*, whereby a fourth locking means is constructed.

The fastening ring 18 is provided with a female thread 18*b* that is screwed with a male thread 3*c* formed on the relay member 3. By tightening the female thread 18*b* of the fastening member 18 to the male thread 3*c* of the relay member 3, a cone-shaped press-contact surface 18*a* formed on the fastening ring 18 is brought pressingly into contact, from the outside, with the front end of the ink reservoir tube 5 mounted on the tapered portion 3*b* of the relay member 3.

With this, ink reservoir tube 5 can be surely attached to the relay member 3.

The ink reservoir tube 5 shown in FIG. 8 is illustrated with a single-layer structure, but a three-layered or a five-layered ink reservoir tube 5, which is previously described, may be employed as appropriate.

The referential sign 5*e* shown in FIG. 8A indicates a publicly known backflow preventive body or follower that is in contact with the back end of the ink in the ink reservoir tube 5 and advances following the consumption of the ink.

Further, the referential sign 3*d* shown in FIG. 8B indicates a backflow preventive ball that prevents air from entering from the tip end of the ballpoint pen tip 2 by closely contacting with the axial bore formed in the relay member 3 when the writing instrument is stored with the ballpoint pen tip 2 upward.

FIGS. 9A and 9B and FIGS. 10A and 10B show an eighth embodiment of the ink reservoir unit. In the ink reservoir unit illustrated in this embodiment, a tubular body 3*e* to which the front end of the ink reservoir tube 5 is integrally formed with the relay member 3 that holds the ballpoint pen tip 2. The fifth locking means 15 of the ink reservoir tube 5 is constructed by including a garter spring, an annular spring, that is housed in the bottom of the tubular body 3*e* and pressingly in contact with the tip end of the ink reservoir tube 5 and a press ring 20 that is mounted in the tubular body 3*e* and locates the garter spring 19 at the inner bottom of the tubular body 3*e*.

The garter spring is a coil spring connected in a circular shape. The diameter of one end of the coil spring is gradually reduced toward the distal end, and the coil spring is connected annularly by inserting the reduced end to the other end.

In this embodiment, the inner diameter of the garter spring 19 is formed smaller than the outer diameter at the front end of the ink reservoir tube 5. The garter spring is housed in the bottom of the tubular body 3*e* formed in the relay member 3 and further, is positioned at the inner bottom of the tubular body 3*e* by a press ring 20 inserted in the tubular body 3*e*.

Consequently, by inserting the front end of the ink reservoir tube 5 toward the opening of the press ring 20, the diameter of the garter spring 19 is expanded by the tip end of the ink reservoir tube 5 and the garter spring can grip the tip end of the ink reservoir tube 5.

The garter spring is held at the inner bottom of the tubular body 3*e* formed in the relay member 3 by the press ring 20 and the state where the ink reservoir tube 5 is connected with the relay member 3 by way of the garter spring 19 is maintained. Thus, with the fifth locking means 15, a fitting action excellent in the durability that the garter spring 19 has can be achieved.

As for the ink reservoir unit 1 described above, examples shown in FIGS. 8A and 8B, FIGS. 9A and 9B, and FIGS. 10A and 10B show the state where the connection part formed in the relay member 3 that holds a ballpoint pen tip 2 is connected to the front end of the ink reservoir tube 5. However, another construction can be adopted in which the ballpoint pen tip 2 is directly connected to the front end of the ink reservoir tube 5.

Further, examples illustrated in FIGS. 5A, 5B and 5C, FIG. 6, and FIGS. 7A, 7B and 7C show the state where the ballpoint pen tip 2 is directly connected to the front end of the ink reservoir tube 5. However, another construction can be adopted in which the connection part formed in the relay member holding the ballpoint pen tip 2 is connected to the front end of the ink reservoir tube 5.

As for the ink reservoir unit 1 described above, examples are shown in which the ink reservoir tube 5 has a three-layered or a five-layered structure using paper-based materials. The use of an ink reservoir tube with a two or more layer structure having a resin or aluminum layer on at least an inner layer on a paper base contributes to providing an environment-friendly ink reservoir unit for writing instruments which reduces the amount of plastic used.

FIGS. 1A and 1B show a first embodiment of a writing instrument using the above-described ink reservoir unit. This embodiment illustrates an example of a composite writing instrument, for example, that houses a plurality of ink reservoir units for writing instruments 1 shown in FIG. 1A in a barrel. The composite writing instrument has a barrel composed of a front barrel 21 and a rear barrel 22. As shown in a cross-sectional view in FIG. 11B, the front barrel 21 and the rear barrel 22 are detachably connected in the axial direction by screwing the male thread 21*a* formed on the rear outer peripheral surface of the front barrel 21 with the female thread 22*a* formed on the front inner circumferential surface of the rear barrel 22.

The tip end of the front barrel 21 is cone-shaped with a reducing diameter and has a tip end opening 23. One of the writing members 2, such as a ballpoint pen tip, of the ink reservoir unit 1 is configured to alternatively advance from the tip end opening 23.

A plurality of guiding slots 24, three in this case, is formed each along the axial direction on the rear end of the rear barrel 22. An operating portion 25*a* formed on the slider 25 protrudes out from the outer peripheral surface of the rear barrel 22 through the corresponding guiding slots 24 and is disposed slidably in the axial direction.

In the rear barrel 22 to which guiding slots are formed, an inner cylindrical member 27 is housed to be positioned inside of the guiding slots 24 A locking face 27*a* that acts to lock the slider 25 in an advanced state is formed on the inner cylindrical member 27.

The rear end portion of the inner cylindrical member 27 is formed to have a small diameter and protrudes slightly from the rear end portion of the rear barrel 22. A cap 29 to which a clip 28 is to be mounted is locked and attached to cover the protruding portion of the inner cylindrical member 27.

An attachment base 29*a* for the clip 28 is integrally formed with the cap 29. The clip 28 is rotatably attached to the cap 29 with a shaft 30 penetrating the attachment base 29*a*. Further, a coil spring 31 is mounted between the cap 29 and the clip 28. A clip ball 28*a* formed on the tip end of the clip 28 is configured to be lightly pressingly in contact with the side surface of the rear barrel 22 by the biasing force of the coil spring 31.

An ink reservoir unit mounting part 25*b* formed at the front end of the slider 25 is press-fitted to the rear opening of the ink reservoir tube 5 in the ink reservoir unit 1.

A return spring 32 is attached to surround the respective ink reservoir tube 5 and slider 25, and which are disposed in the barrel in a biased state toward the rear side by the return spring 32.

When the operating portion 25*a* of one of the sliders 25 is moved forward in this state, the operating portion 25*a* of the slider 25 is moved forward along a groove formed in the inner cylindrical member 27 and falls toward the axial direction of the barrel. This causes the rear locking portion 25*c* of the slider 25 to be locked to the locking face 27*a* formed on the inner cylindrical member. At this point, the ink reservoir unit 1 attached to the slider 25 bends properly due to its flexibility, and the ballpoint pen tip 2 of the ink reservoir unit is held in a delivered state from the tip end opening 23.

In addition, when a second slider 25 is moved forward, a locking release cam 25*d* formed on the second slider 25 abuts on the rear end locking portion 25*c* of the first slider 25 which is already locked in a delivered state, and the locking release cam 25*d* pushes the rear end locking portion 25*c* of the first slider 25 outside, whereby the locked state of the first slide 25 is released.

As a result, the first slider 25 retracts due to the action of the return spring 32, and the rear end locking portion 25*c* of the second slider 25 is locked to the locking face 27*a* formed in the inner cylindrical member 27; thus, the ballpoint pen tip 2 delivered from the tip end opening 23 can be exchanged.

Figure 11A:
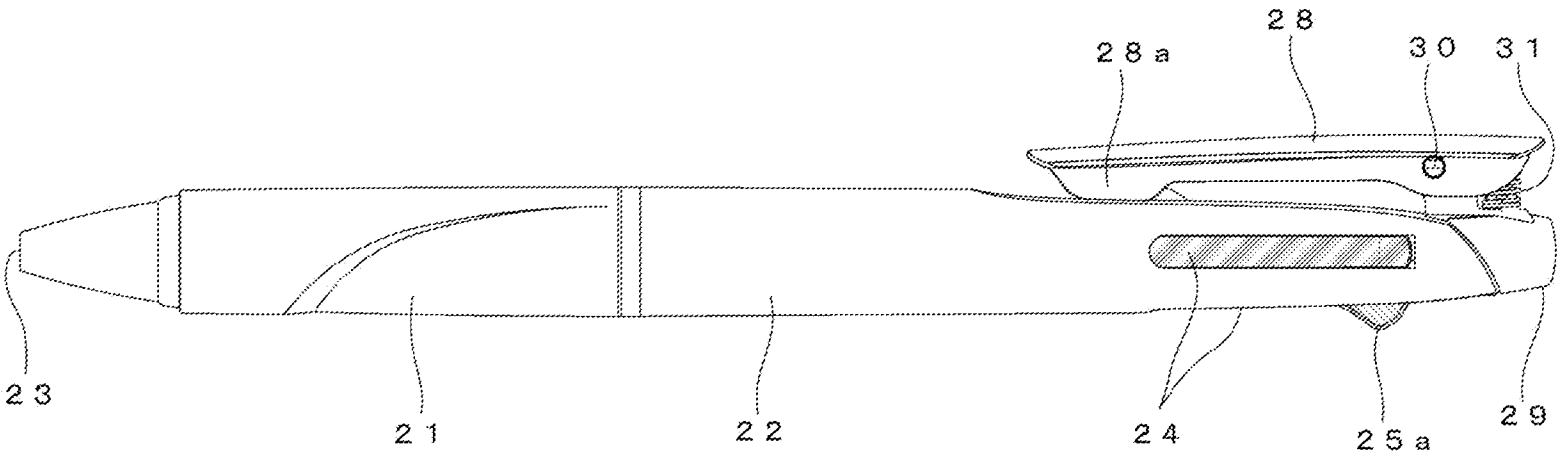
FIG. 11A and FIG. 11B show an entire constitution of a first embodiment according to the present invention.
Figure 11B:
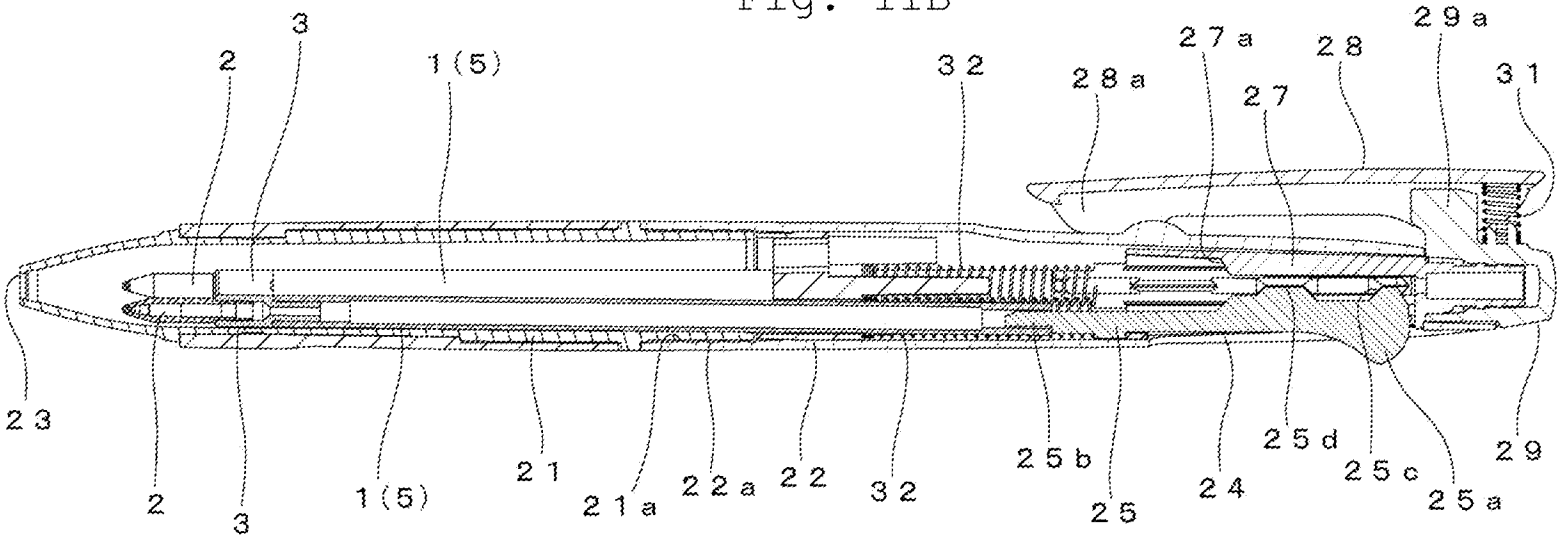

The composite writing instrument shown in FIGS. 11A and 11B is an example of a use of the ink reservoir unit according to the present invention. The ink reservoir unit according to the present invention can be used in a ballpoint pen writing instrument having a single ink reservoir unit housed in the barrel, not only for the composite writing instrument shown in FIGS. 11A and 11B.

Figure 12A:
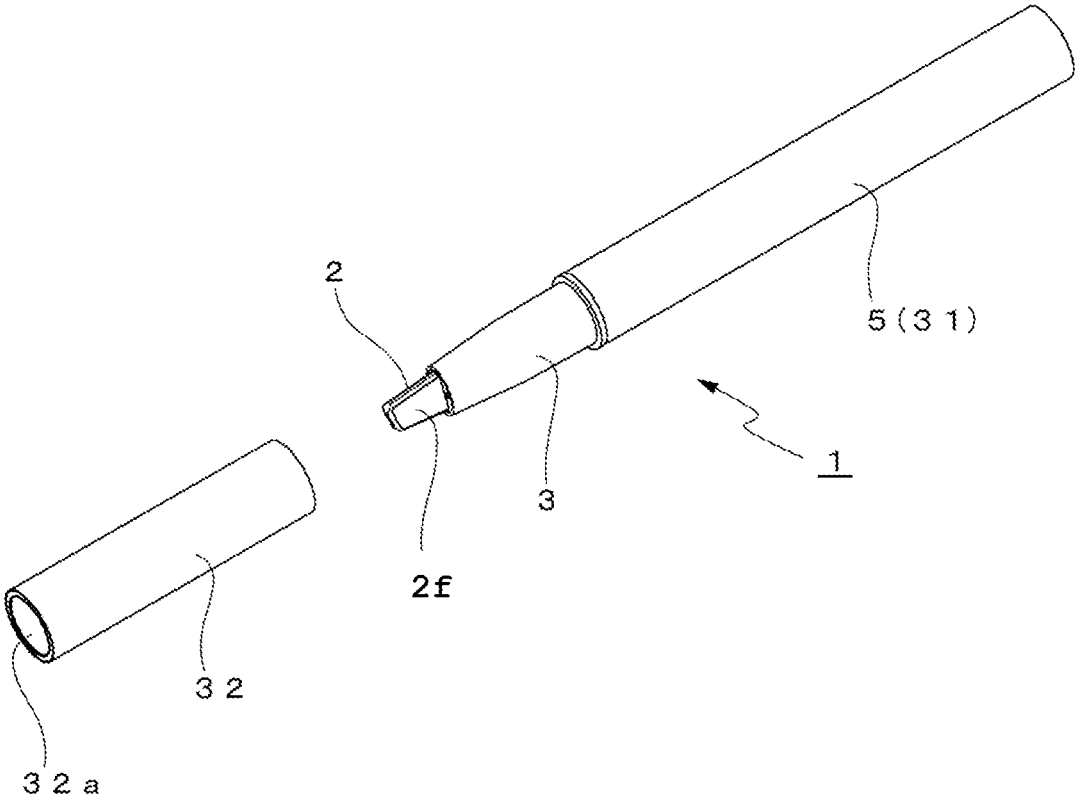
FIG. 12A and FIG. 12B show an entire constitution of a second embodiment of a writing instrument according to the present invention.
Figure 12B:
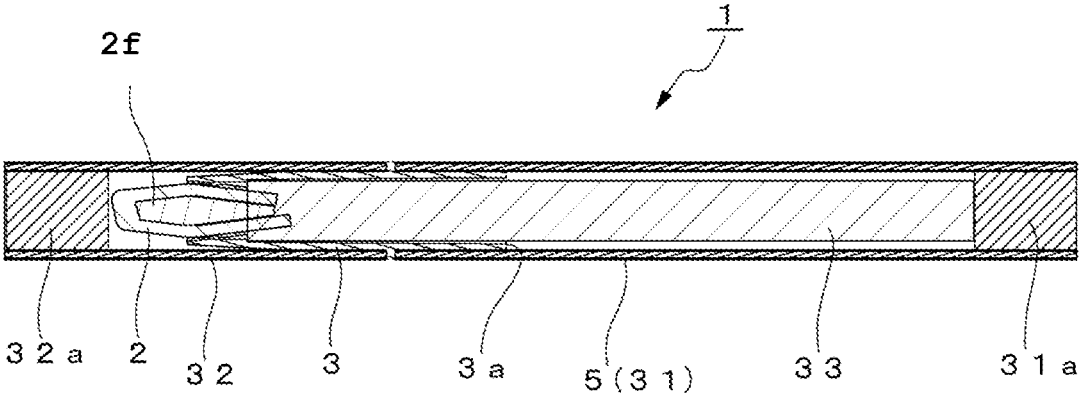

FIGS. 12A and 12B show a second embodiment of the writing instrument according to the present invention. The second embodiment is characterized in that the ink reservoir tube is composed of a paper-based material and the ink reservoir tube constitutes a barrel as a grip of the writing instrument.

The writing instrument shown in FIGS. 12A and 12B is a writing instrument called "an underscoring pen" and allows drawing bold lines with the provision of a thick writing member 2.

Synthesized resin fibers bundled to a rod shape or a porous material made of sintered high-molecular material is used for the writing member 2 at the tip end for an underscoring pen of this kind. An ink supplied from the ink reservoir tube 5 of the writing instrument body is lead to the writing member 2 and allows writing lines.

In association with the widespread of underscoring pens having ink reservoir tubes 5 containing fluorescent ink, a variety of underscoring pens allowing drawing thick lines are provided.

Users can make a wide selection of underscoring pens depending on their usage and the workability becomes comfortable.

As for the writing instrument in FIGS. 12A and 12B, the ink reservoir tube 5 of the ink reservoir unit for writing instruments 1 is formed to a cylindrical shape, also serving as a barrel 31 as a grip. As described above, the ink reservoir tube 5 is composed of a paper-based material, and more preferably an ink reservoir tube composed of two or more layers including a resin or aluminum layer as the inner layer is used.

A three-layered structure shown in FIG. 1B or a five-layered structure shown in FIG. 3C, for example, can be employed for the ink reservoir tube 5 as appropriate.

The tail end of the ink reservoir tube 5 which also serves as a barrel 31 is closed with a tail cap 31*a*, and the front end of the ink reservoir tube 5 is connected by fitting with the connection part 3*a* formed on the rear half of the relay member 3. Further, a writing member 2 is attached to the tip end of the ink reservoir tube 5 by way of the relay member 3.

The writing member 2 is formed by attaching an approximately U-shaped porous member along the outer periphery of a transparent flat-plate support member 2*f*.

An ink occluding body 33 to which ink is impregnated is housed in the ink reservoir tube 5, and the ink from the ink occluding body 33 is supplied to the porous member composing the writing member 2. With this, the writing member 2 allows the drawing of lines.

Since a window-shaped visible portion is formed on the writing member 2 by using a transparent support member 2*f* for the writing member 2, characters printed on the paper can be recognized through the visible portion. This allows drawing lines accurately with the writing member 2.

For the writing instruments shown in FIGS. 12A and 12B, a cap 32 to cover the writing member 2 is prepared; the cap 32 is preferably formed of a paper-based material similar to the ink reservoir tube 5 which also serves as the barrel 32.

To form a cap 32, a sealing plug 32*a* made of a similar material to the tail cap 31*a* is attached to a crown part of the cap 32. The cap 32 is detachably mounted to the body of the writing instrument, by being mounted on a front half portion of the relay member 3 holding the writing member 2.

Figure 13A:
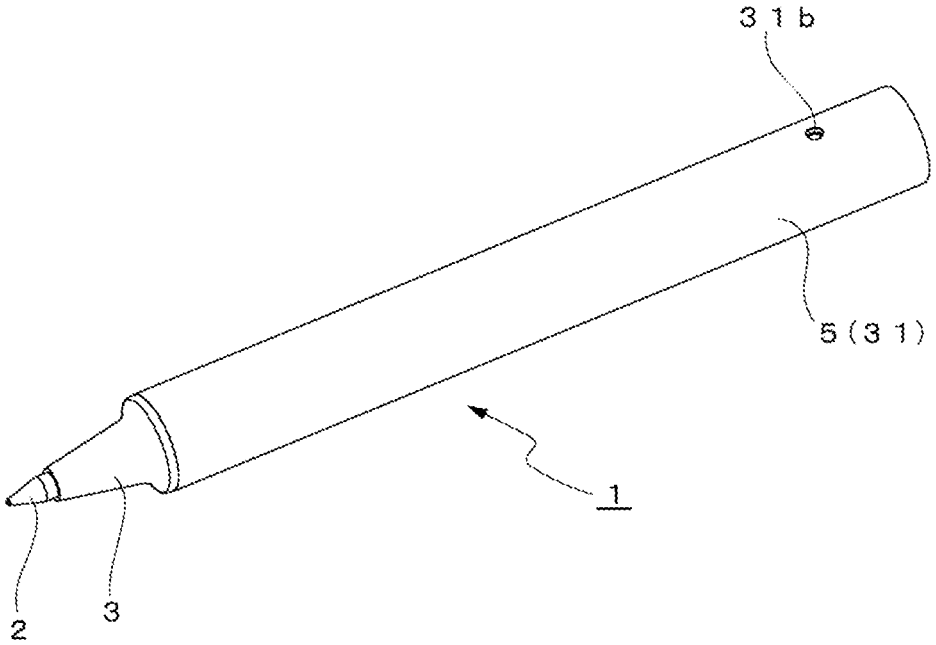
FIG. 13A through FIG. 13C show an entire constitution of a writing instrument according to a third embodiment.
Figure 13B:
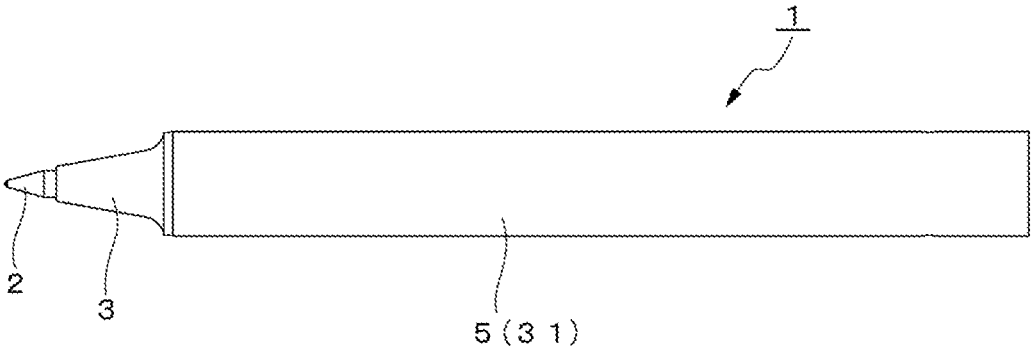
Figure 13C:
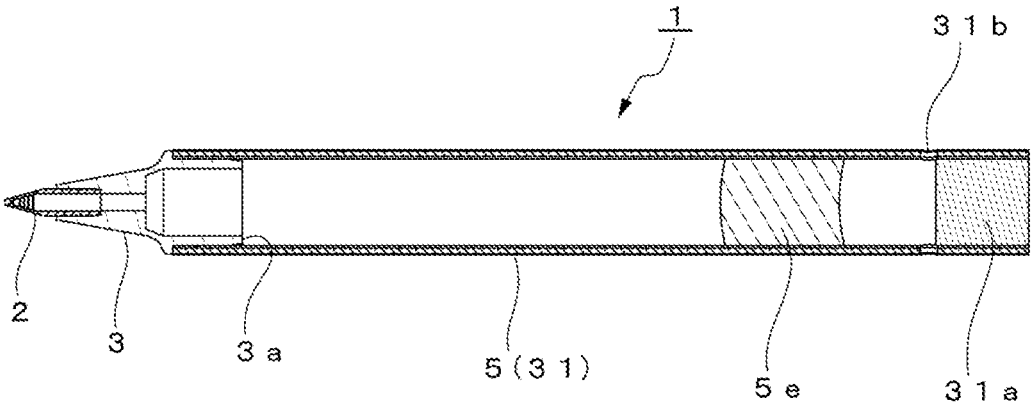

FIGS. 13A, 13B, and 13C show a third embodiment of the writing instrument according to the present invention and show an example in which the ink reservoir tube is adopted to a ballpoint writing instrument.

Also in the third embodiment, the ink reservoir tube 5 of the ink reservoir unit 1 is composed of a paper-based material and forms the barrel 31 as a grip.

Namely, as for the ink reservoir tube 5 in the example, similarly to the writing instrument of the second embodiment shown in FIGS. 12A, 12B, and 12C, the outer layer of the ink reservoir tube 5 is composed of a paper-based material, and preferably an ink reservoir tube 5 composed of two or more layers including a resin or aluminum layer as the inner layer is used.

Further, a three-layered structure shown in FIG. 1B or a five-layered structure shown in FIG. 3C, for example, can be employed for the ink reservoir tube 5 as appropriate.

The tail end of the ink reservoir tube 5 which also serves as a barrel 31 is closed with a tail cap 31*a*, and the front end of the ink reservoir tube 5 is attached by fitting with the connection part 3*a* formed on the rear half of the relay member 3. Further, a ballpoint pen tip as a writing member 2 is connected to the tip end of the ink reservoir tube 5 by way of the relay member 3.

The referential sign 5*e* in FIG. 13C indicates a backflow preventive body, a follower, that is in contact with the back end of the ink in the ink reservoir tube 5 and advances following the consumption of the ink. Therefore, the ink not shown in the drawing is stored in between the follower 5*e* and the relay member 3 of the ink reservoir tube 5. Further, the referential sign 31*b* in FIG. 13C indicates an air hole formed on the barrel 31.

As for the second embodiment of the writing instrument and the third embodiment of the writing instrument shown respectively in FIGS. 12A, 12B, and 12C and FIGS. 13A, 13B, and 13C, the corresponding connection part 3*a* to the ink reservoir tube 5 formed on the relay member 3 has a straight cylinder shape. Therefore, a certain connection strength is imparted to the ink reservoir tube 5, also serving as a barrel 31 connected by fitting, by applying an adhesive to the connection part 3*a* in advance.

In the writing instruments according to the present invention, to secure the connection strength of the front end of the ink reservoir tube 5 also serving as a barrel 31, various kinds of locking means and reinforcing members described based on FIGS. 2A through 10B can be adopted as appropriate. With this, writing instruments having excellent practicability in which a certain connection strength of the ink reservoir tube 5 is secured can be provided.

LIST OF REFERENTIAL SIGNS

1 ink reservoir unit
2 writing member
2*a* connection part
2*b* writing ball
2*f* support member
3 relay member
3*a* connection part
3*b* tapered portion
3*c* male thread
3*e* tubular body
5 ink reservoir tube
5*a*1 base layer
5*al* first base layer
5*a*2 second base layer
5*b* inner layer
5*c* outer layer
5*d* resin layer
11 locking means
11*a* male thread
12 second locking means (annular locking member)
12*a* tapered surface
12*b* falling portion
13 third locking means (protrusion)
13*a* tapered surface
13*b* falling portions
14 fourth locking means
15 fifth locking means
16 ring-shaped reinforcing member
17 reinforcing member, having a C character shape cross-section
18 fastening ring
18*a* press-contact surface
18*b* female thread
19 garter spring
20 press ring
21 front barrel (barrel)
22 rear barrel (barrel)
23 tip end opening
31 barrel
32 cap
33 ink occluding body

The invention claimed is:

1. An ink reservoir unit for writing instruments to be housed in a barrel, comprising an ink reservoir tube formed using paper as a base material;

wherein one end of the ink reservoir tube is connected with a connection part formed to a writing member or formed on a relay member holding the writing member, wherein the ink reservoir unit is configured to be housed in the barrel, wherein at the connection part at which the ink reservoir tube is connected with the writing member or the relay member holding the writing member a locking means is provided that comprises a tapered portion formed on the writing member or the relay member to which the front end opening of the ink reservoir tube is to be connected and a fastening ring having a press-contact face that is pressingly in contact with an outer surface of the ink reservoir tube at the tapered portion, and wherein the ink reservoir tube is connected by the locking means to the writing member or the relay member.

2. The ink reservoir unit according to claim 1, wherein the fastening ring is provided with a female thread that is to be screwed into a male thread provided on the writing member or the relay member.

3. A writing instrument housing the ink reservoir unit recited in claim 1 in a barrel.

4. A writing instrument, wherein the ink reservoir tube in the ink reservoir unit recited in claim 1 constitutes a barrel serving as a grip.

5. An ink reservoir unit for writing instruments to be housed in a barrel, comprising an ink reservoir tube formed using paper as a base material;

wherein one end of the ink reservoir tube is connected with a connection part formed to a writing member or formed on a relay member holding the writing member, wherein the ink reservoir unit is configured to be housed in the barrel, wherein at the connection part at which the ink reservoir tube is connected with the writing member or the relay member holding the writing member a locking means is provided that comprises a tubular body formed on the writing member or the relay member and to which the front end of the ink reservoir tube is inserted, a garter spring housed in a bottom portion of the tubular body and being pressingly in contact with the front end of the ink reservoir tube and a pressing ring housed in the tubular body to position the garter spring at the bottom portion of the tubular body, and wherein the ink reservoir tube is connected by the locking means to the writing member or the relay member.

6. An ink reservoir unit, comprising an ink reservoir tube formed using paper as a based material;

wherein one end of the ink reservoir tube is connected with a connection part formed to a writing member or formed on a relay member holding the writing member, wherein at the connection part at which the ink reservoir tube is connected with the writing member or the relay member holding the writing member a fourth locking means is provided that comprises a tapered portion formed on the writing member or the relay member to which the front end opening of the ink reservoir tube is to be connected and a fastening ring having a press-contact face that is pressingly in contact with an outer surface of the ink reservoir tube at the tapered portion, and wherein the ink reservoir tube is connected by the fourth locking means to the writing member or the relay member.

7. The ink reservoir unit according to claim 6, wherein the fastening ring is provided with a female thread that is to be screwed into a male thread provided on the writing member or the relay member.

8. An ink reservoir unit, comprising an ink reservoir tube formed using paper as a based material;

wherein one end of the ink reservoir tube is connected with a connection part formed to a writing member or formed on a relay member holding the writing member, wherein at the connection part at which the ink reservoir tube is connected with the writing member or the relay member holding the writing member a locking means is provided that comprises a tubular body formed on the writing member or the relay member and to which the front end of the ink reservoir tube is inserted, a garter spring housed in a bottom portion of the tubular body and being pressingly in contact with the front end of the ink reservoir tube and a pressing ring housed in the tubular body to position the garter spring at the bottom portion of the tubular body, and wherein the ink reservoir tube is connected by the locking means to the writing member or the relay member.

* * * * *